US006341386B1

(12) United States Patent
Phillips et al.

(10) Patent No.: US 6,341,386 B1
(45) Date of Patent: Jan. 29, 2002

(54) PORTABLE POTTY APPARATUS

(76) Inventors: William A. Phillips; Pamela Phillips, both of 1629 S. Church, Bozeman, MT (US) 59715

( * ) Notice: Subject to any disclaimer, the term of this patent is extended or adjusted under 35 U.S.C. 154(b) by 0 days.

(21) Appl. No.: 09/468,594

(22) Filed: Dec. 21, 1999

Related U.S. Application Data

(63) Continuation-in-part of application No. 09/292,356, filed on Apr. 16, 1999, now abandoned.

(51) Int. Cl.[7] ..... A47K 11/06
(52) U.S. Cl. ..... 4/484; 4/479
(58) Field of Search ..... 4/484, 479, 460, 4/902, 236, 240; 383/36, 105, 120, 126

(56) References Cited

U.S. PATENT DOCUMENTS

| | | | | | |
|---|---|---|---|---|---|
| 629,434 | A | * | 7/1899 | Farmer | 4/484 |
| 1,246,791 | A | * | 11/1917 | Salati | 4/483 |
| 1,342,715 | A | * | 6/1920 | Howe | 297/17 |
| 1,419,947 | A | * | 6/1922 | Schouten | 297/17 |
| 1,482,073 | A | * | 1/1924 | Ferdinand | 4/483 |
| 1,650,365 | A | * | 11/1927 | Kuhn | 4/483 |
| 2,064,628 | A | * | 12/1936 | Reflovich | 4/240 |
| 2,631,699 | A | * | 3/1953 | Schultz | 297/17 |
| 2,776,438 | A | * | 1/1957 | Zeraffa | 4/483 |
| 2,814,048 | A | * | 11/1957 | Reinhard | |
| 2,974,321 | A | * | 3/1961 | Salka | 297/17 |
| 3,061,262 | A | * | 10/1962 | Nika | 4/483 |
| 3,142,847 | A | | 8/1964 | Kurrels | |
| 3,203,007 | A | * | 8/1965 | Olson | |
| 3,235,884 | A | * | 2/1966 | Rehsteiner | 4/484 |
| 3,471,874 | A | * | 10/1969 | Dixon | |
| 3,619,822 | A | | 11/1971 | Carmichael | |
| 3,771,493 | A | | 11/1973 | Chandor | |
| 3,802,000 | A | * | 4/1974 | Waldon | |
| 4,633,536 | A | * | 1/1987 | Trubble-DuBose | 4/479 |
| 5,161,263 | A | * | 11/1992 | Geneve et al. | 4/483 |
| 5,170,516 | A | * | 12/1992 | Davison | 4/479 |
| 5,187,819 | A | | 2/1993 | Grimes | |
| 5,309,580 | A | * | 5/1994 | Amalsad et al. | 4/483 |
| 5,564,136 | A | * | 10/1996 | Cox | 4/480 |
| 5,611,092 | A | | 3/1997 | Van Dusen | |
| 6,116,780 | A | * | 9/2000 | Young et al. | 383/44 |

* cited by examiner

*Primary Examiner*—Charles R. Eloshway

(57) ABSTRACT

A portable potty apparatus comprises a base unit which includes a top base surface and a bottom base surface. A seat unit is hingedly connected to the top base surface. A plurality of folding legs are connected to the bottom base surface. The seat unit includes a seat ring. The top base surface includes a bag ring reception groove for receiving the top portion of a bag holder. A sealing or clamping member attaches the bag holder to the base unit underneath the seat ring. A disposable bag for collecting human waste is adapted to be supported in the bag holder in proximity to the seat ring and the seat unit. The folding legs include a front leg and a pair of rears. Each of the front leg and the rear legs includes a leg hinge portion which is received in a complimentary leg hinge reception portion in the base unit. A top cover is provided for connection to the base unit. The top cover includes top cover lock tabs, and the base unit includes lock tab reception slots for receiving the top cover lock tabs. A bottom cover is also provided for connection to the base unit. The bottom cover includes bottom cover lock tabs which fit into the lock tab reception slots. The same cover may be used as the top cover or as the bottom cover.

14 Claims, 10 Drawing Sheets

FIG 1
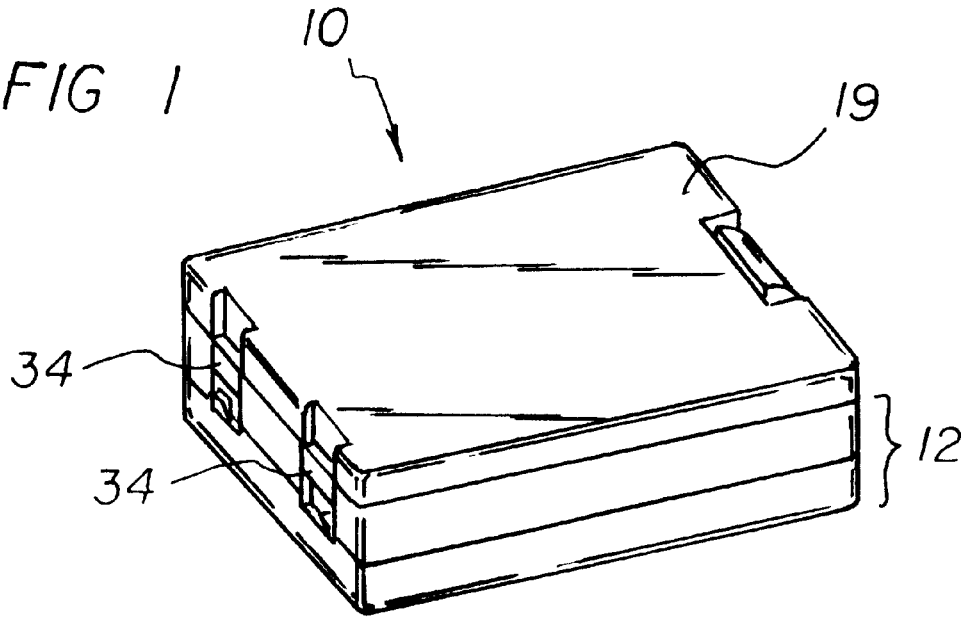
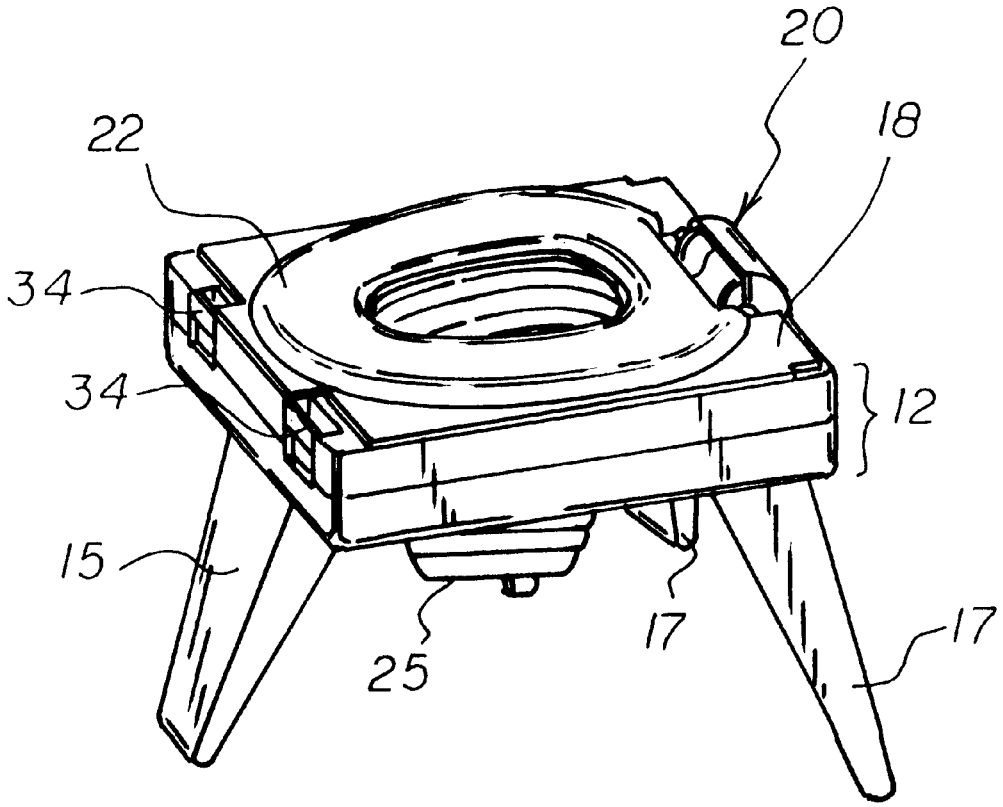
FIG 2

20
22
18
34
34
12
17
17
15

5
20
17
17
22
18
34
34
15
5

FIG 7
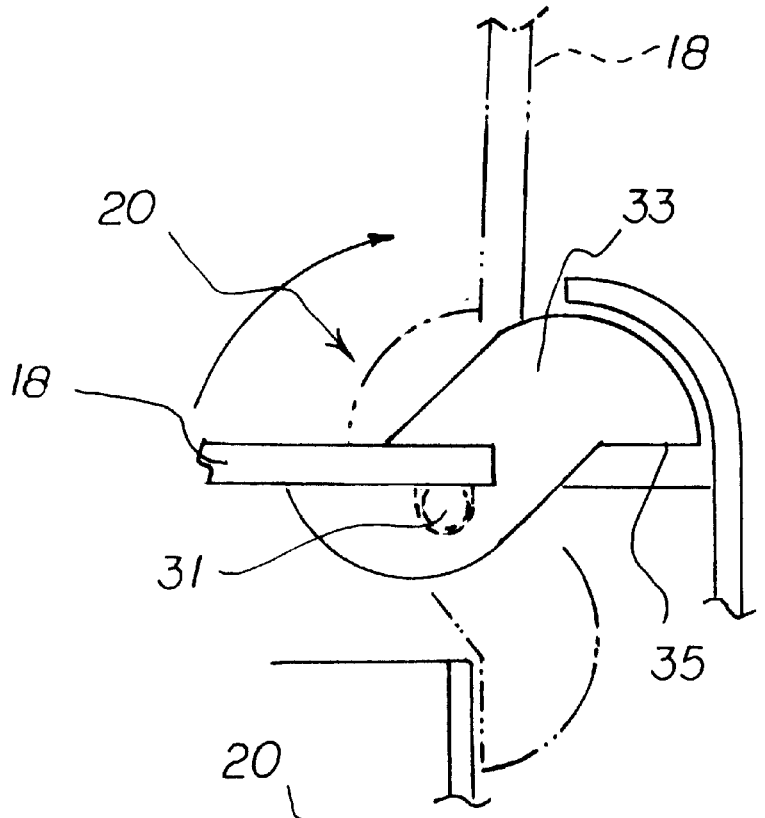
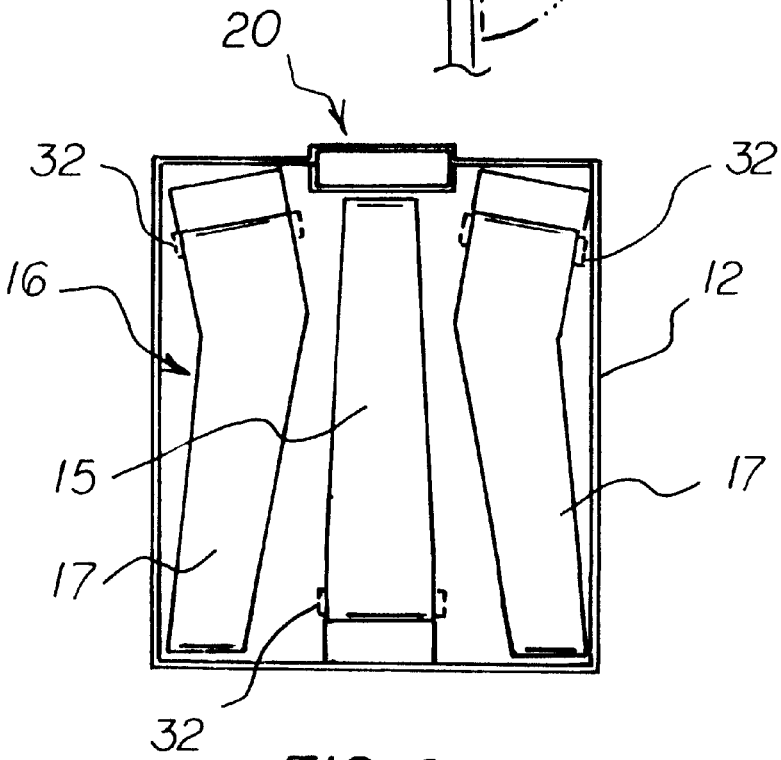
FIG 8

FIG 17
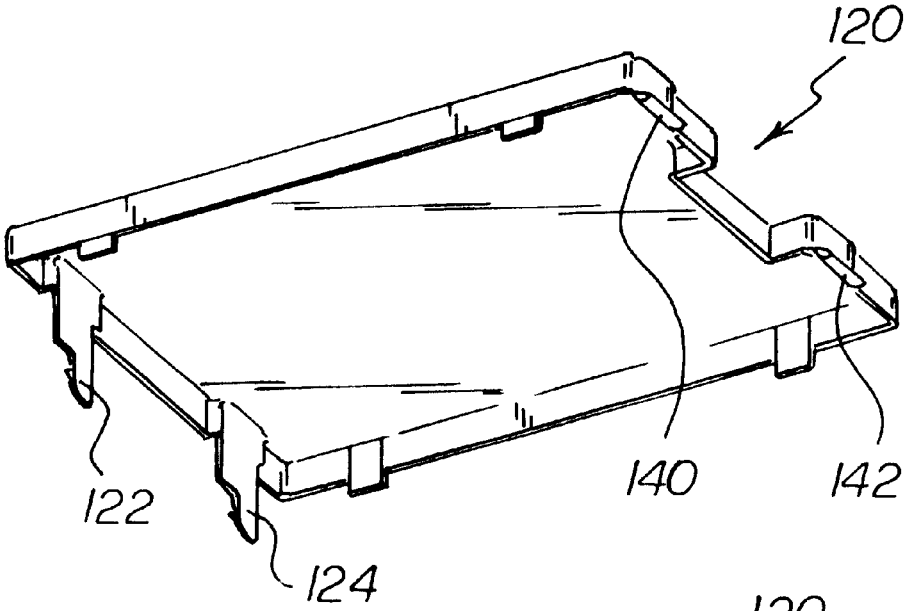
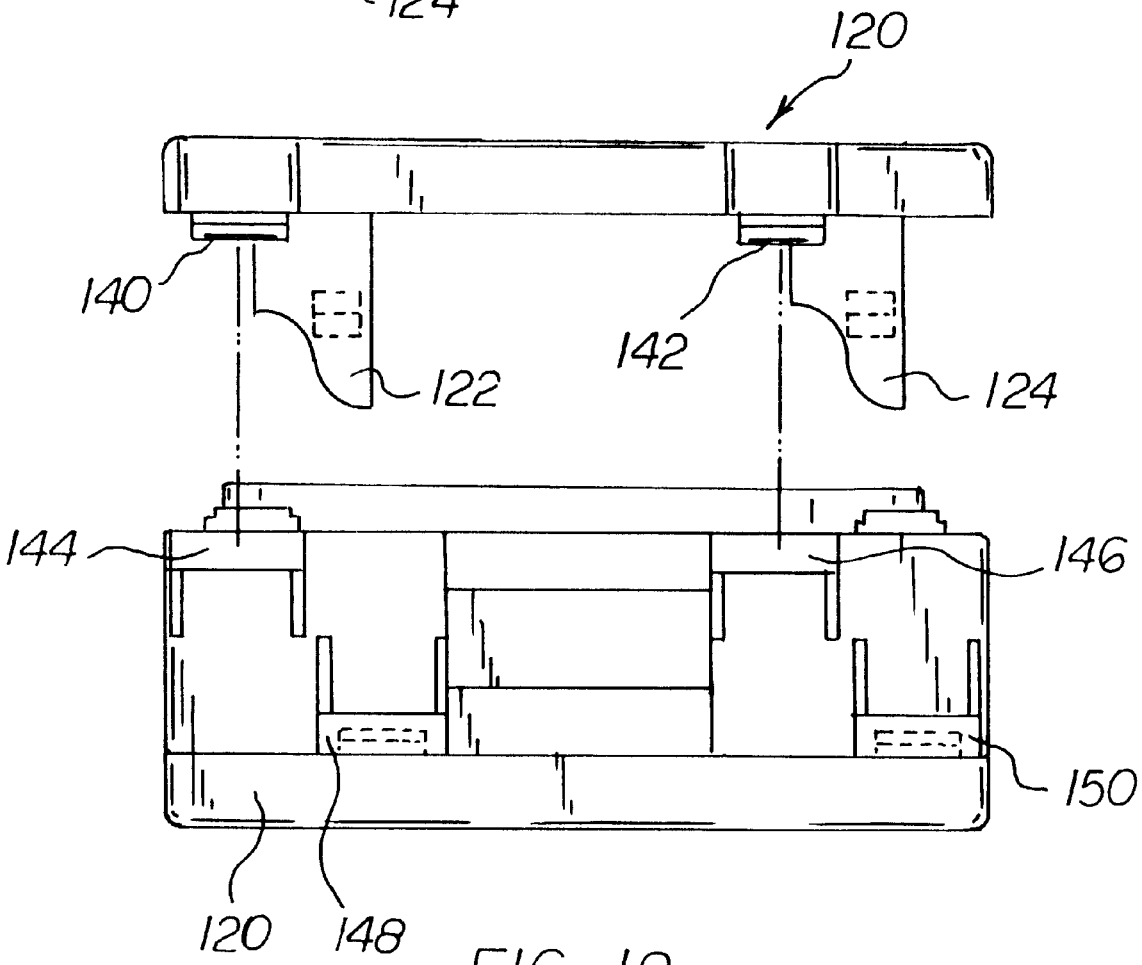
FIG 18

PORTABLE POTTY APPARATUS

RELATED APPLICATION

This application is a continuation-in-part of application, Ser. No. 09/293,356; filed Apr. 16, 1999, now abandoned.

BACKGROUND OF THE INVENTION

1. Field of the Invention

The present invention relates generally to portable toilet devices and, more particularly, to portable toilet devices which include disposable bags.

2. Description of the Prior Art

Portable toilets are used in a number of contexts. For example, toddlers who are being toilet trained often use portable toilets known as potties. Similar portable toilets are often used on camping trips and in motor vehicles. Bedpans, that are used in hospitals and other convalescent care environments, are other forms of portable toilets.

Throughout the years, a number of innovations have been developed relating to portable toilets, and the following U.S. patents are representative of some of those innovations: U.S. Pat. Nos. 3,142,847, 3,235,884, 3,619,822, 5,187,819, and 5,611,092. Each of U.S. Pat. Nos. 3,142,847, 3,619,822, 5,187,819, and 5,611,092 discloses a portable toilet that has a flat planar floor that rests on a support surface. Each flat planar floor has a bottom surface area that extends the full length and width of the portable toilet. When such a portable toilet is lifted off of the support surface, the entire bottom surface may have to be cleaned if the support surface was dirty, such as in the outdoors. To avoid the need for cleaning an entire bottom surface of a portable toilet, it would be desirable if a portable toilet were provided with several legs that rest on the support surface. Several legs would be easier to clean than an entire bottom surface of a portable toilet.

More specifically, U.S. Pat. No. 3,142,847 discloses a portable toilet that does not include a seat ring which is virtually always included in a fixed toilet. To improve comfort and provide a portable toilet that more closely simulates a fixed toilet, it would be desirable if a portable toilet were provided with a seat ring. In addition, once the temporary need for a portable toilet has passed, the portable toilet is often folded up or packed up and transported to another location. This patent does not disclose a handle that would facilitate carrying of the portable toilet. In this respect, it would be desirable if a portable toilet were provided with a carry handle that facilitates transport of the portable toilet when it is not in use. Furthermore, with this patent, a disposable bag that is employed must be big enough to fit over the full outside length and width of the base portion. As a result, the disposable bag may be relatively large compared to the amount of wastes which it is intended to carry. As a result, significant quantities of bag materials may be underutilized and wasted. In this respect, it would be desirable if a portable toilet were provided that permits the use of disposable bags that are considerably smaller than the full outside length and width of the base portion.

U.S. Pat. No. 3,619,822 discloses a portable toilet that employs disposable plastic bags that are, in essence, made in the portable toilet itself on a continuous basis. To make the bags, heat sealing apparatus is provided. For purposes of simplicity, it would be desirable if a portable toilet were provided that uses readily available, pre-made, disposable plastic bags.

U.S. Pat. No. 5,187,819 also discloses a portable toilet that has no seat ring, no seat legs, and employs big bags that fit over the full length and width of the base portion.

U.S. Pat. No. 5,611,092 discloses a portable toilet that employs a drawer-like base for a container that receives wastes. The container is carried by the drawer-like base is rigid and is not intended to be disposable, and, therefore, must be cleaned for further use and for storage. To avoid time and effort that must be spent to clean non-disposable waste receivers, it would be desirable for a portable toilet to use only disposable flexible bags for receiving wastes.

U.S. Pat. No. 3,235,884 discloses a portable nursery chair with folding legs underneath a seat ring and a flexible sheet forming a pot suspended therefrom. It would be desirable if the folding legs were encased completely in a base unit and adapted to be covered when the unit is transported; and it would be desirable if a separate bag holder were used to support an easily disposable bag for containing wastes.

As a matter of interest, U.S. Pat. No. 3,771,493 discloses a container for receiving pet wastes. It is noted that a disposable plastic bag is engaged by lugs on a lid which push through slots on a container. Portions of the disposable bag are pushed through the slots by the lugs and are susceptible to damage, such as tearing, as a result. In this respect, it would be desirable if a disposable bag were retained in a portable toilet in such a way that the disposable bag is not subjected to significant tearing forces.

Still other features would be desirable in a portable potty apparatus. For example, as mentioned above, it would be desirable for a portable toilet to have a seat ring and a holder for a disposable bag that does not subject the disposable bag to significant tearing forces. For purposes of simplicity and economy, it would be desirable if a single integrated structure were provided which had both a seat ring and a disposable bag holder.

With fixed toilets, the seat ring is on a hinge, and when the seat ring is lifted, it rotates around the hinge. To emulate such a fixed toilet, it would be desirable if a portable toilet has a seat ring structure which is connected to a base by means of a hinge and which rotates around the hinge when the seat ring is lifted.

When the portable toilet is being transported, it would be desirable if the portable toilet had both a top cover and a bottom cover to cover both the top and bottom portions of the portable toilet, respectively. Such top and bottom covers would provide a neat looking apparatus for transportation and storage.

Thus, while the foregoing body of prior art indicates it to be well known to use portable toilets, the prior art described above does not teach or suggest a portable potty apparatus which has the following combination of desirable features: (1) has several legs that rest on a support surface and provide stable support; (2) has a seat ring; (3) has a carry handle that facilitates transport of the portable toilet when it is not in use; (4) permits the use of disposable bags that are considerably smaller than the full outside length and width of the base portion; (5) uses readily available, pre-made, disposable plastic bags; (6) uses flexible disposable bags for receiving wastes; (7) has an integrated structure which has both a seat ring and a disposable bag holder; (8) has a seat ring structure connected to a base by means of a hinge and which rotates around the hinge when the seat ring is lifted; (9) has both a top cover and a bottom cover to cover both the top and bottom portions of the portable toilet, respectively; (10) holds a disposable bag in such a way that the disposable bag is not subjected to significant tearing forces; (11) has a unique disposable bag holder with an easy to use flexible retainer member; (12) has a uniquely shaped disposable bag; (13) has a hingedly mounted seat unit with a seat ring which unit may be removed, elevated to a preferred non-use position, or maintained in a down, operative use position; and (14) has a single cover of standard size and configuration which may be used to cover either the top or the bottom of the apparatus when the apparatus is in a folded-up non use storage mode. The foregoing desired characteristics are provided by the unique portable potty apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a portable potty apparatus which includes a base unit which includes a top base surface and a bottom base surface. A seat unit is hingedly connected to the base unit. A plurality of folding legs are connected to the bottom base surface. The seat unit includes a seat ring. The top base surface includes a bag ring reception groove for receiving the top portion of a bag holder. A sealing or clamping member attaches the bag holder to the base unit underneath the seat ring. A disposable bag for collecting human waste is adapted to be supported in the bag holder in proximity to the seat ring and the seat unit.

The folding legs include a front leg and a pair of rears. Each of the front leg and the rear legs includes a leg hinge portion which is received in a complimentary leg hinge reception portion in the base unit.

A top cover is provided for connection to the base unit. The top cover includes top cover lock tabs, and the base unit includes lock tab reception slots for receiving the top cover lock tabs. A bottom cover is also provided for connection to the base unit. The bottom cover includes bottom cover lock tabs which fit into the lock tab reception slots. The same cover may be used as the top cover or as the bottom cover.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable potty apparatus which has all of the advantages of the prior art and none of the disadvantages.

It is another object of the present invention to provide a new and improved portable potty apparatus which may be easily and efficiently manufactured and marketed.

It is a further object of the present invention to provide a new and improved portable potty apparatus which is of durable and reliable construction.

An even further object of the present invention is to provide a new and improved portable potty apparatus which is susceptible of a low cost of manufacture with regard to both materials and labor, and which accordingly is then susceptible of low prices of sale to the consuming public, thereby making such portable potty apparatus available to the buying public.

Still yet a further object of the present invention is to provide a new and improved portable potty apparatus which has several legs that rest on a support surface.

Still another object of the present invention is to provide a new and improved portable potty apparatus that has a seat ring.

Yet another object of the present invention is to provide a new and improved portable potty apparatus which has a carry handle that facilitates transport of the portable toilet when it is not in use.

Even another object of the present invention is to provide a new and improved portable potty apparatus that permits the use of disposable bags that are considerably smaller than the full outside length and width of the base portion.

Still a further object of the present invention is to provide a new and improved portable potty apparatus which uses readily available, pre-made, disposable plastic bags.

Yet another object of the present invention is to provide a new and improved portable potty apparatus that uses flexible disposable bags for receiving wastes.

Still another object of the present invention is to provide a new and improved portable potty apparatus which has an integrated structure which has both a seat ring and a disposable bag holder.

Yet another object of the present invention is to provide a new and improved portable potty apparatus that has a seat ring structure connected to a base by means of a hinge and which rotates around the hinge when the seat ring is lifted.

Still a farther object of the present invention is to provide a new and improved portable potty apparatus that has both a top cover and a bottom cover to cover both the top and bottom portions of the portable toilet, respectively.

Yet another object of the present invention is to provide a new and improved portable potty apparatus which holds a disposable bag in such a way that the disposable bag is not subjected to significant tearing forces.

Another object of the present invention is to provide a new and improved portable potty apparatus which has a unique disposable bag holder with an easy to use flexible retainer member.

Still another object of the present invention is to provide a new and improved portable potty apparatus which has a uniquely shaped disposable bag containing waste material.

Still yet another object of the present invention is to provide a new and improved portable potty apparatus which has a hingedly mounted seat unit with a seat ring which unit may be removed, elevated to a preferred non-use position, or maintained in a down, operative use position.

Still yet an even further object of the present invention is to provide a new and improved portable potty apparatus which has a single cover of standard size and configuration which may be used to cover either the top or the bottom of the apparatus when the apparatus is in a folded-up non use storage mode.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the portable potty apparatus of the invention in a closed condition for transport and storage.

FIG. 2 is a perspective view of the embodiment of the portable potty apparatus shown in FIG. 1 in an open condition for use thereof with the legs in an extended condition.

FIG. 7 is an enlarged view of the portion of the embodiment of the invention shown in FIG. 5 that is included in circled region 7 thereof.

FIG. 8 is a bottom view of the embodiment of the invention shown in FIG. 2 with the legs in a folded condition.

FIG. 17 is a perspective view of the cover employed with the alternatively preferred embodiment of the invention shown in FIG. 10 showing the underside thereof and more particularly, the cover locking tab members thereof.

FIG. 18 shows an exploded assembly of the alternatively preferred embodiment of FIGS. 10–17 showing one end in elevation and further showing the top cover ready to be installed and a bottom cover already installed.

DESCRIPTION OF THE PREFERRED EMBODIMENT

Figure 3:
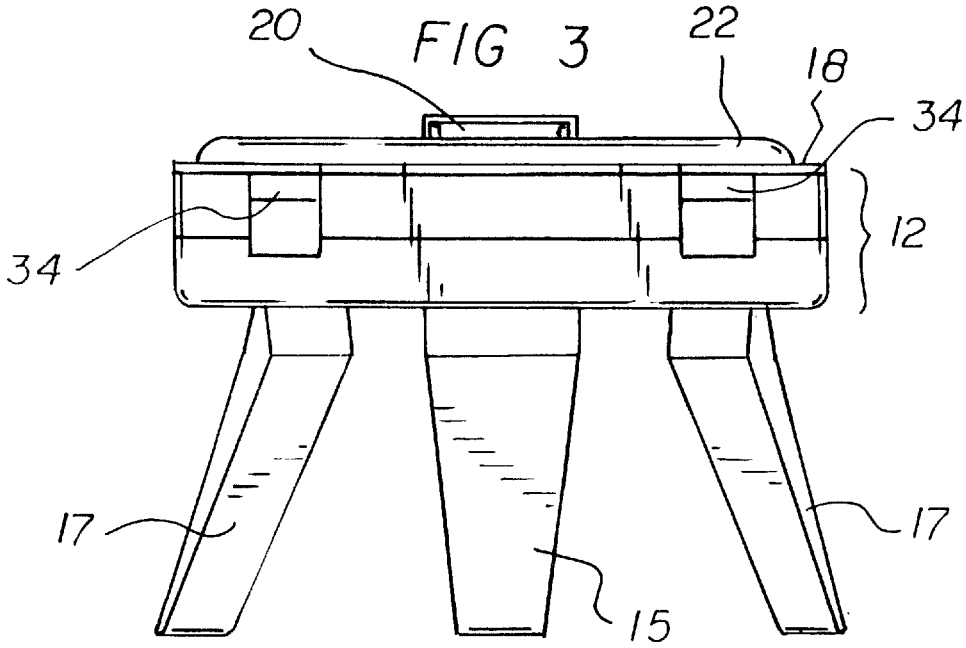
FIG. 3 is an enlarged rear view of the embodiment of the invention shown in FIG. 2.
Figure 4:
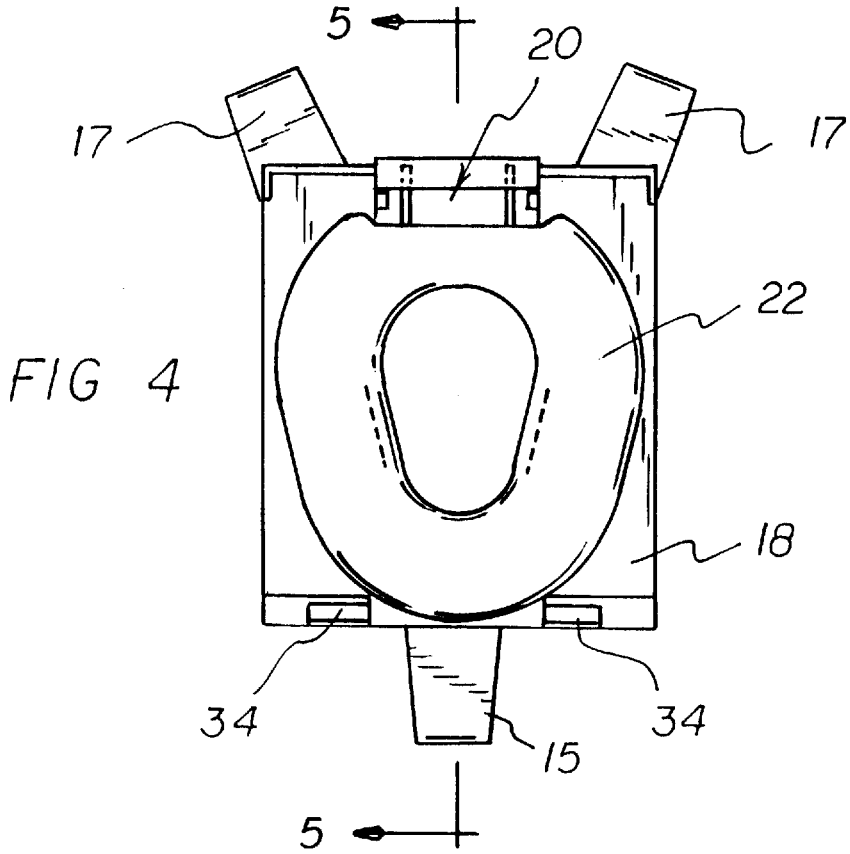
FIG. 4 is a top view of the embodiment of the invention shown in FIG. 3.

With reference to the drawings, a new and improved portable potty apparatus embodying the principles and concepts of the present invention will be described.

Turning to FIGS. 1–9, there is shown an exemplary embodiment of the portable potty apparatus of the invention generally designated by reference numeral 10. In its preferred form, portable potty apparatus 10 includes a base unit 12 which includes a top base surface 14 and a bottom base surface 16. A seat unit 18 is connected to the base unit 12 by means of a hinge 20. A plurality of folding legs are connected to the bottom base surface 16. The seat unit 18 includes a seatring 22. The hinge 20 includes stationary hinge pins 31 connected to the base unit 12 and movable hinge wings 33 connected to the seat unit 18. Each of the hinge wings 33 includes a hinge stop surface 35 for limiting rotational movement of the hinge wings 33 around the hinge pins 31.

A bottom side of the seat unit 18 includes a bag locking ring 24. The top base surface 14 includes a bag ring reception groove 28 for receiving the bag locking ring 24. A bag holder 25 includes a holder locking flange 37 which is received in the bag ring reception groove 28 between the bag ring reception groove 28 and the bag locking ring 24. The holder locking flange 37 includes a bag rim reception track 26.

The folding legs include a front leg 15 and a pair of rear legs 17. Each of the front leg 15 and the rear legs 17 includes a leg hinge portion 30 which is received in a complimentary leg hinge reception portion 32 in the base unit 12.

In accordance with the present invention, front leg 15 and rear legs 17 are uniquely configured to provide enhanced stability and support of base unit 12 and seat unit 18 when the apparatus 10 is placed on a generally horizontal surface in an in-use condition. More specifically, front leg 15 generally is straight in its longitudinal extent and the hinge axis thereof is generally parallel to the end edge or side of base unit 12. With respect to rear legs 17 on the other hand, each hinge axis therefore is at an acute angle with respect to the proximal end or edge of base unit 12 and the longitudinal extent thereof respectively is not straight, i.e. each rear leg 17 has a first proximal portion extending orthogonal to its hinge axis 32 and a second distal portion angularly offset with respect to the aforementioned first portion. These unique angular relationships among front leg 15 and rear legs 17 and the bottom surface 16 of base member 12 are best seen in FIG. 8 (the angular break in legs 17 are omitted in FIG. 3 for the sake of clarity). By placing the hinge axes of rear legs 17 at an angle to the end edge of the base unit (i.e. non-parallel), and providing an angular break in each leg 17, the legs may be folded into the compact arrangement illustrated in FIG. 8 and when unfolded and in the in use condition the distal portions or "feet" of each rear leg 15 will contact the horizontal supporting surface (or ground) at a position extending beyond both the end nearest edge and the adjacent side edges of the base member 12 as substantially viewed in FIG. 4. This extra-wide "footprint" afforded by the hingedly extended legs 15 and 17 (FIG. 4) provides superior stabilized support to the base unit 12 in the in-use condition particularly when the supporting surface or ground upon which the apparatus is placed is uneven as would be experienced for example, when the invention is used outdoors at campsites or the like. By way of illustration, and not to limit the invention, with respect to the preferred embodiment described, the angle of axis of hinge 32 for each rear leg 17 with respect to the proximal end edge preferably is about 30 degrees whereas the angle of the break in each leg's longitudinal extent (i.e. the angle between the first leg portion and the second distal leg portion) preferably is about 30 degrees.

A top cover 19 is provided for connection to the base unit 12. The top cover 19 includes top cover lock tabs 36, and the base unit 12 includes lock tab reception slots 34 for receiving the top cover lock tabs 36. A bottom cover 21 is also provided for connection to the base unit 12. The bottom cover 21 includes bottom cover lock tabs 38 which fit into the lock tab reception slots 34. The top cover lock tabs 36 and the bottom cover lock tabs 38 are offset from each other so that a single top cover lock tab 36 and a single bottom cover lock tab 38 can share a lock tab reception slot 34 when the top cover 19 and the bottom cover 21 are connected to the base unit 12. The bottom cover 21 further includes bottom side engagement tabs 40 for engaging the bottom base surface 16 when the bottom cover 21 is connected to the base unit 12.

Figure 5:
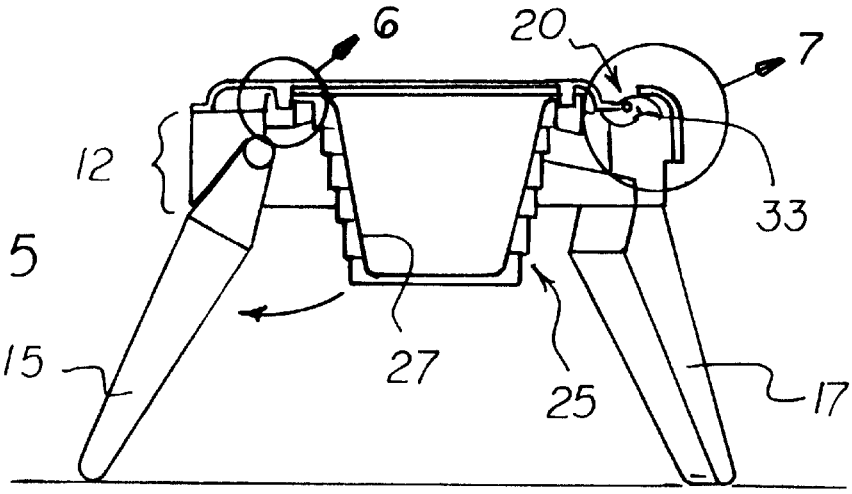
FIG. 5 is a cross-sectional view of the embodiment of the invention shown in FIG. 4 taken along line 5—5 thereof.
Figure 6:
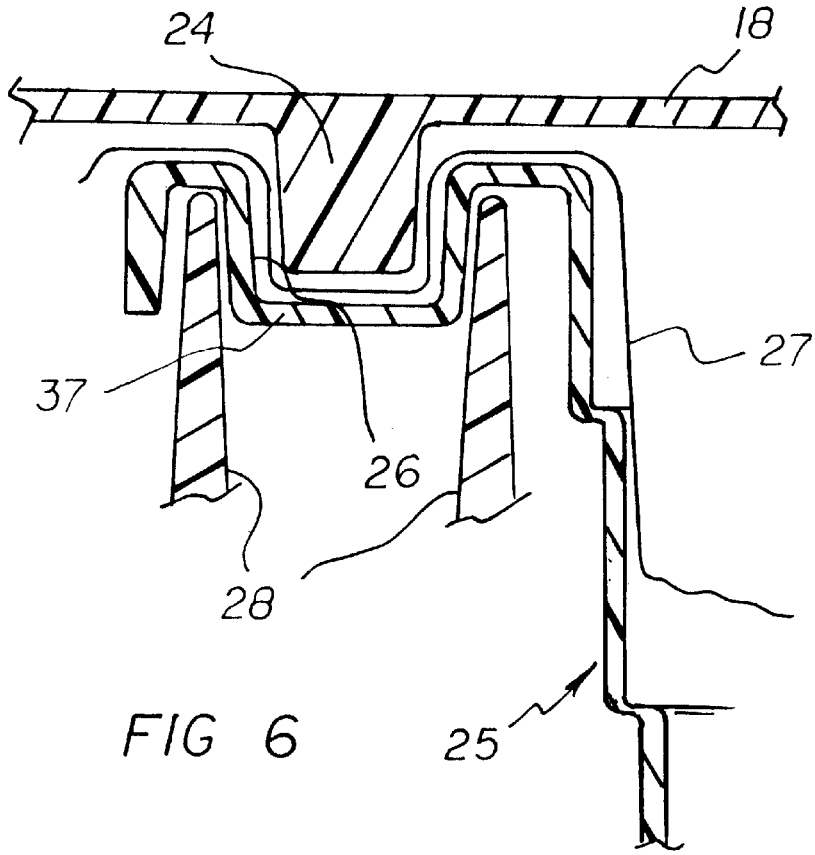
FIG. 6 is an enlarged view of the portion of the embodiment of the invention shown in FIG. 5 that is included in circled region 6 thereof.
Figure 9:
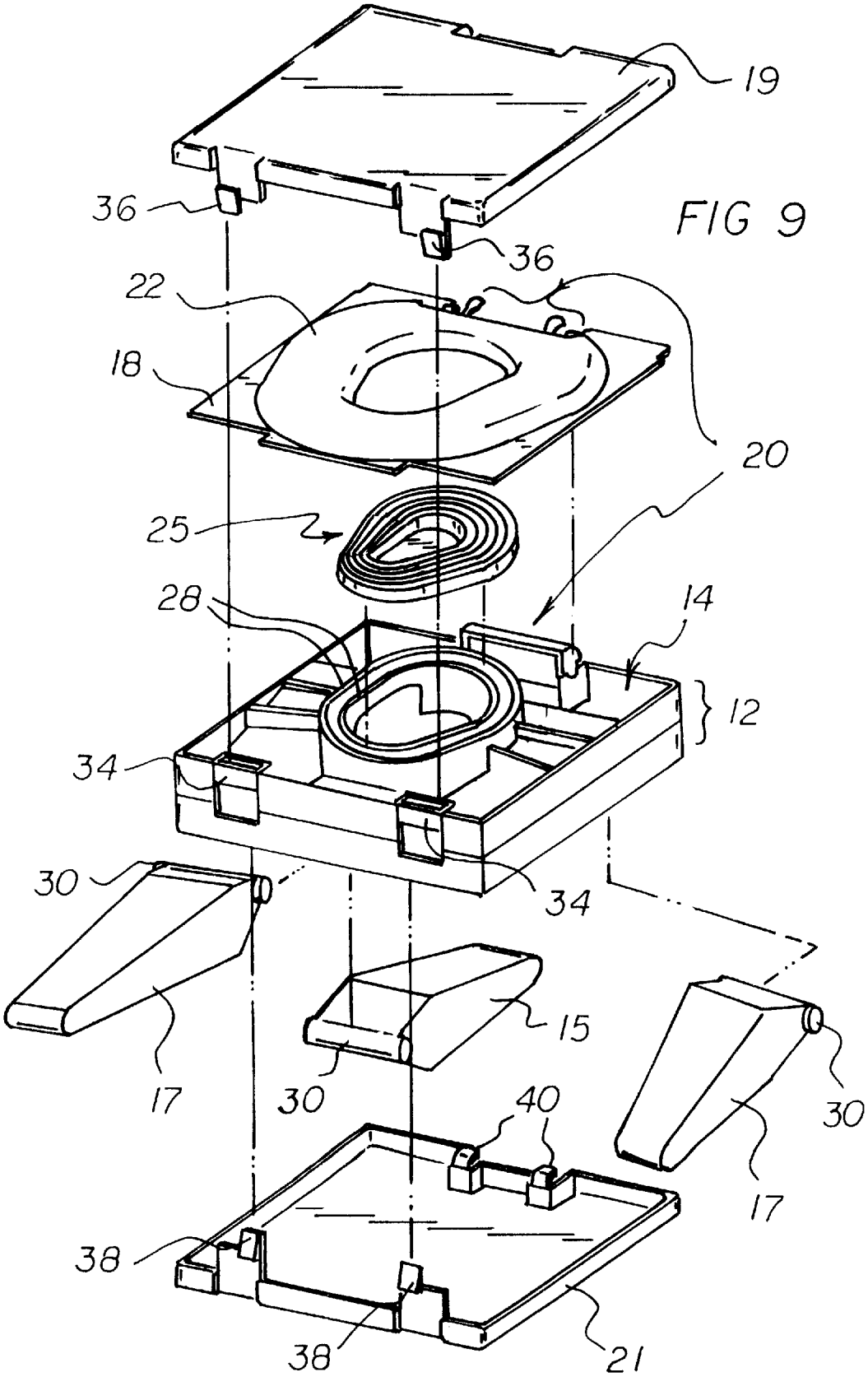
FIG. 9 is an exploded perspective view of the embodiment of the invention shown in FIG. 1.

The portable potty apparatus 10 can be stored in the closed condition shown in FIG. 1. To change the closed condition to the in-use condition shown in FIG. 2, the top cover 19 is removed from the base unit 12. To do so, the top cover lock tabs 36 in the top cover 19 are unlatched from the lock tab reception slots 34 in the base unit 12. Then, the front leg 15 and the rear legs 17 are unfolded from under the base unit 12. That is, the front leg 15 and the rear legs 17 are rotated around the respective leg hinge portions 32 of the respective legs. The bag holder 25 is made from plastic material formed in an accordion-like expanded form. When the portable potty apparatus 10 is closed, the accordion-like bag holder 25 is in a collapsed condition such as shown in FIG. 9. However, when the portable potty apparatus 10 is in an in-use condition, such as shown in FIG. 2, the bag holder 25 is in an extended condition and is ready to receive a disposable bag 27, such as shown in FIGS. 5 and 6.

To place a disposable bag 27 in the portable potty apparatus 10, the seat unit 18 is lifted to rotate around the hinge 20. The holder locking flange 37 of the bag holder 25 is positioned over the bag ring reception groove 28 of the base unit 12. The main body portion of the disposable bag 27 is placed inside the bag holder 25, and the top rim of the disposable bag 27 is situated in the bag rim reception track 26 of the holder locking flange 37. Then, the seat unit 18 is lowered around the hinge 20 so that the bag locking ring 24 on the seat unit 18 fits into the bag rim reception track 26. As shown in FIG. 6, when this is done, the top rim of the disposable bag 27 is sandwiched between the bag locking ring 24 and the holder locking flange 37. In addition, the bag ring reception groove 28 of the base unit 12 supports the holder locking flange 37 and the top rim of the disposable bag 27.

It is noted that the rotation of the seat unit 18 around the hinge 20 is limited. More specifically, as shown in FIG. 7, the hinge 20 includes hinge wings 33, and each hinge wing 33 includes a hinge stop surface 35. When the seat unit 18 is in a horizontal orientation, as shown with the solid lines in FIG. 7, the hinge stop surface 35 is not in contact with the base unit 12. However, when the seat unit 18 is lifted, such as shown in the broken lines in FIG. 7, the hinge stop surface 35 has been moved into contact with an outer wall surface of the base unit 12. This outer wall surface of the base unit 12 serves as a stop for the hinge stop surface 35 to prevent the seat unit 18 from rotating further around the hinge 20.

To change a soiled disposable bag 27, the seat unit 18 is lifted, the top rim of the disposable bag 27 is removed from the bag rim reception track 26, and the disposable bag 27 is sealed or tied up. Then, a fresh disposable bag 27 is installed in the portable potty apparatus 10 as described above.

When the portable potty apparatus 10 is no longer to be used, a soiled disposable bag 27 is removed and disposed of. A fresh disposable bag 27 can be installed in the portable potty apparatus 10. Then, the front leg 15 and the rear legs 17 are folded, and the bag holder 25 is pushed into the collapsed condition. The top cover 19 can be installed on the base unit 12 having top cover lock tabs 36 engaging the lock tab reception slots 34.

Also, as shown in FIG. 9, a bottom cover 21 can also be employed with the portable potty apparatus 10 of the invention. The bottom cover lock tabs 38 are offset from the top cover lock tabs 36 and fit into the same lock tab reception slots 34 in the base unit 12. To carry the portable potty apparatus 10, the hinge 20 area of the apparatus can serve as a handle.

Turning now to FIGS. 10 through 20, there is described an alternatively preferred embodiment of the invention wherein the portable potty apparatus 10 has several features at variation to the preferred embodiment of FIGS. 1–9. The variations manifest in the preferred embodiment of FIGS. 10–20 are believed to enhance the apparatus with respect to ease and cost of manufacture, and with respect to its appeal to the consuming public. Therefore, the alternatively preferred embodiment of the invention below is mostly preferred and may be referred to herein as the "mostly preferred embodiment."

In terms of its general organization, the mostly preferred embodiment includes a base unit, a seat unit, hinged front and rear legs, and a top cover and a rear cover, all essentially arranged in the same manner as the embodiment of FIGS. 1–10. However, the bag holder and disposable bag assembly, the seat unit and seat unit hinge assembly, and the top and bottom covers are somewhat differently configured as will now be described in turn.

Figure 10:
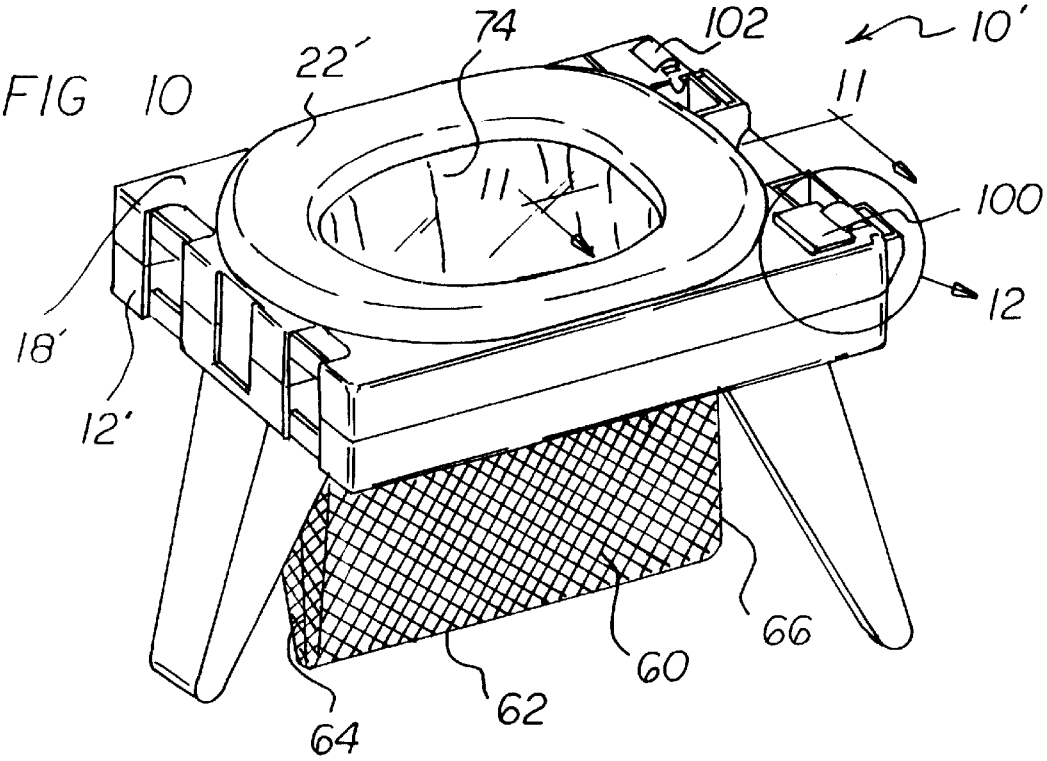
FIG. 10 is a perspective view of an alternatively preferred embodiment of the portable potty apparatus of the invention shown in an open condition (top cover off) for use thereof with the legs in an extended condition.
Figure 11:
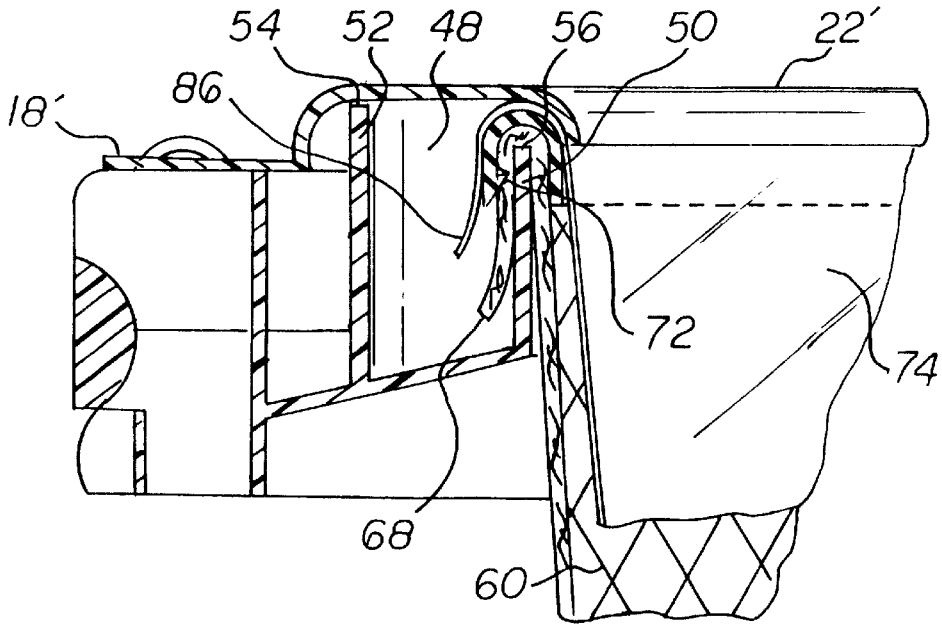
FIG. 11 is an enlarged cross-section view of a portion of the alternatively preferred embodiment shown in FIG. 10 taken along line 11—11 in FIG. 10.
Figure 12:
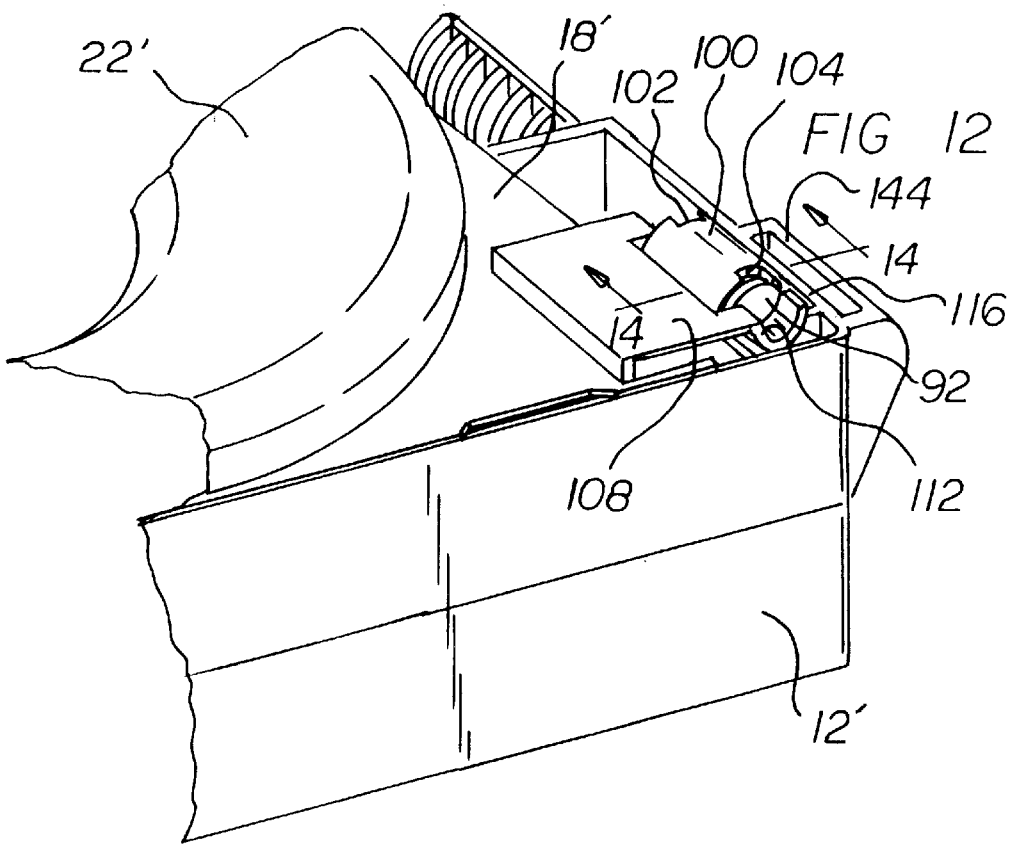
FIG. 12 is an enlarged perspective view of the corner portion of the alternatively preferred embodiment of FIG. 10 indicated by circle 12.
Figure 13:
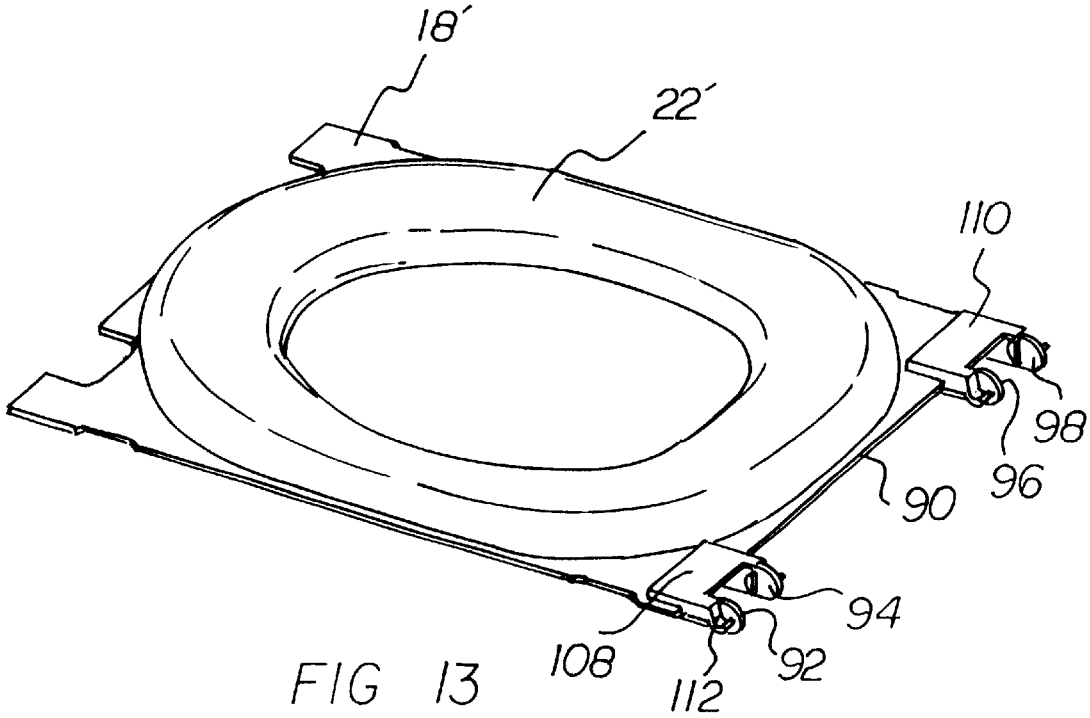
FIG. 13 is a perspective view of the seat ring of the alternatively preferred embodiment of FIG. 10 showing the hinge arms and locking members on one end thereof.
Figure 14:
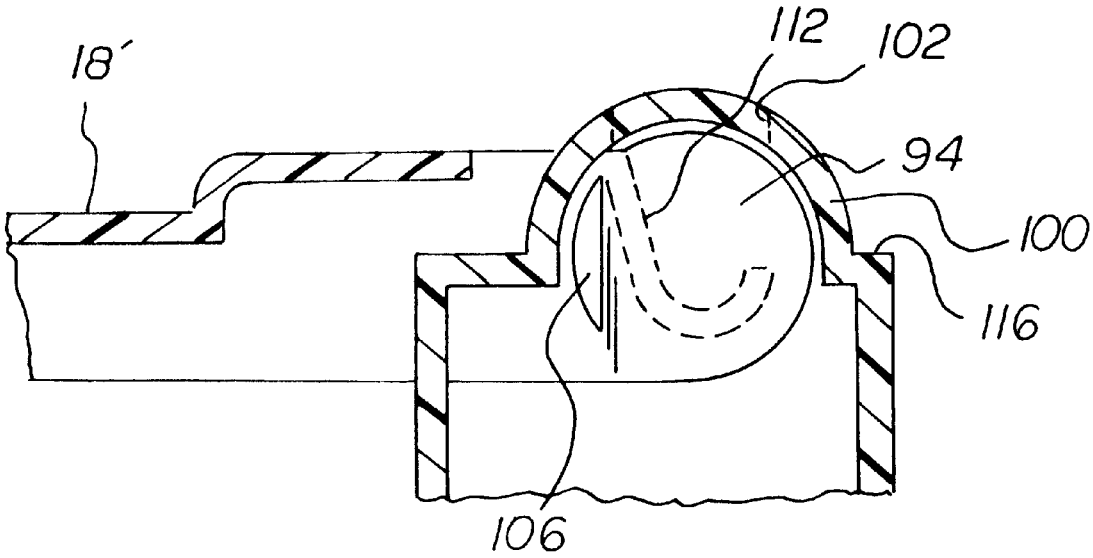
FIG. 14 is an enlarged cross-sectional view of a portion of an hinge arm showing its locking member in respect of the alternatively preferred embodiment of FIG. 10 schematically showing the interaction between these parts when the seat ring is in a down position.
Figure 16:
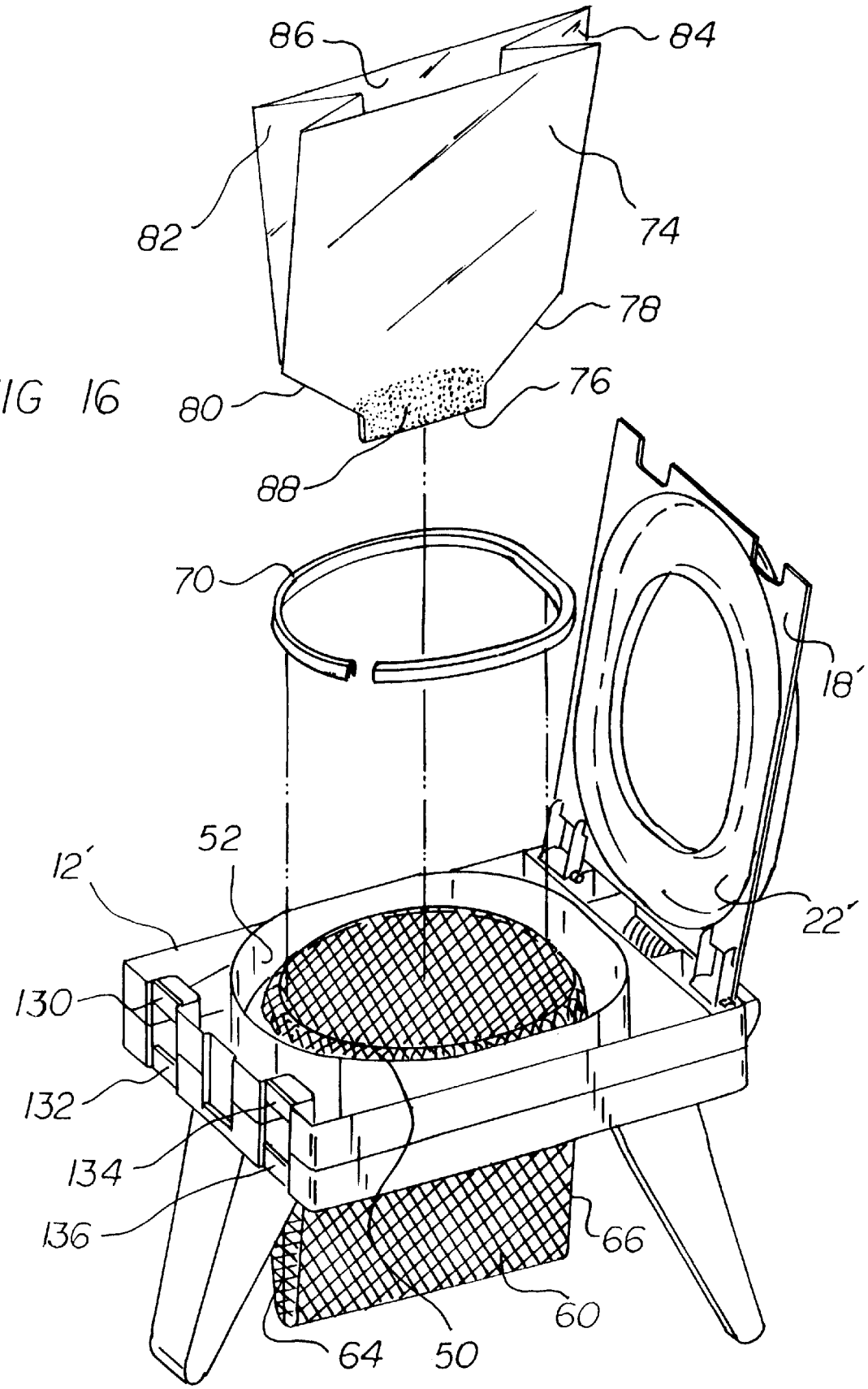
FIG. 16 is an exploded perspective view of the alternatively preferred embodiment of FIG. 6 with the seat unit and seat ring in an up position showing the relation between the mesh bag holder, the mesh bag holder securement member, and the disposable bag for insertion in the mesh bag holder, all in accordance with the present invention.

Turning to FIGS. 10, 11 and 16, a bag reception groove 48 is formed by a pair of spaced circumferentially extending upright annular walls 50, 52 with the top edge 54 of the radially outer wall 52 being slightly elevated with respect to the top edge 56 of the radially inner wall 50. The underside of seat ring 22' is substantially smooth and arcuately shaped more or less as shown (i.e. there is no locking ring 24). A removable bag holder 60 is provided comprising a flexible bag of open mesh construction similar to "fish netting" in appearance. The removable bag holder 60 has a sealed bottom edge 62, a pair of sealed, opposed side edges 64, 66 and an opening in its top defined by a peripheral or annual top rim portion 68. In accordance with the mostly preferred embodiment of the invention, the mesh bag holder top rim portion 68 is adapted to be selectively removably attached to the top edge 56 of radially inner wall 50 by means of a flexible removable sealing or clamping member 70. Sealing or clamping member 70 is fabricated of a suitable flexible plastic material and has a transverse cross-sectional shape which may be characterized by an upside-down "U." One leg of the upside down U-shaped member (the outer leg) has an inside extending barbed edge 72 created by an angled cut for retention purposes as will be made more evident below and as substantially shown in FIG. 11. Flexible sealing member 70 has a longitudinal extent slightly less than the circumferential extent of the top end portion 56 of inner radial wall 50 so that the open end of the sealing member may receive the top end therein when the sealing member is pressed thereagainst.

A disposable bag 74 is provided for selective insertion into bag holder 60. In accordance with the mostly preferred embodiment, disposable bag 74 has a sealed bottom edge comprising a medial straight horizontal portion 76 and first and second lateral angled portions 78, 80 (FIG. 16). The bag 74 furthermore comprises a pair of sealed, opposed edges 82, 84 each of which is characterized by a substantially V-shaped fold (FIG. 16) terminating upwardly in a top edge peripheral portion 86 defining a top opening for the bag 74. The combination of the V-shaped folds in the side edges, and the lateral angled bottom edge portion unexpectedly forms an efficient funnel between the bag's top opening and the medial straight horizontal portion advantageously channelling any waste material deposited in the disposable bag from the top opening toward the bottom straight horizontal medial portion of the bag. In accordance with the mostly preferred embodiment, a quantity of gelling compound in granulated form 88 preferably is deposited interiorly of the bag 74 and normally reposes in the bottom, medial horizontal straight portion thereof which forms a natural confinement space for the granulated gel compound. It is well known in the art of portable toilets to use such granulated gelling compounds to form a gelled material when contacted by human waste material and the particular composition of such granulated gelling compounds forms no part of the present invention. In carrying out the present invention, one or more disposable bags 74, preferably with a known, commercially available granulated gel compound inside, is folded up and stored in a smaller plastic bag with a conventional top locking edge (e.g. ZIP-LOK™ bags) and provided with the apparatus of the invention until used.

To place a disposable bag 74 in the portable potty apparatus 10' (mostly preferred version), the seat unit 18' is lifted to rotate around its hinges. The main portion of mesh bag 60 is placed within the opening defined by inner radial wall 50 and the top edge portion 68 of the mesh bag holder is draped over the top edge 56 of the inner radial wall 50. The open end of the flexible sealing member 70 then is pressed against the mesh bag holder and the top edge 56 until seated all the way around the top edge with the barbed edge 72 thereof engaging the mesh bag material to facilitate retaining the mesh bag on the top edge 50 substantially as illustrated in FIG. 11. The disposable bag 74 next is removed from its protective ZIP-LOK™ bag (not shown), unfolded, and the main body portion thereof placed inside the open main body portion of the mesh bag holder 60 which latter is suspended from the top edge 56 of inner radial wall 50 by means of sealing member 70. The top edge portion 86 of the disposable bag 74 then is draped over the top edge of the sealing member 70 (FIG. 11) and the seat unit 18' and seat ring 22' lowered to its operative position (FIG. 10). It will be observed that the underside of the curved seat ring 22' in the operative portion rests upon the top edge 54 of outer radial outer wall 52 on the one hand, and the sandwich of the top edge portion 86 of disposable bag 74, the flexible sealing member 70, and the top edge portion 68 of mesh bag holder 60 seated on the top edge 56 of the inner radial wall 50, on the other hand. By the forgoing arrangement, the seat ring is substantially structurally supported by the inner and outer radial walls, and the seat ring tightly and securely maintains the disposable bag the sealing member and the mesh bag in its operative position. It will be further noted that the foregoing arrangement is capable of wide flexibility in use. For example, it is not absolutely necessary to place the top edge or rim portion 86 of the disposable bag 74 between the sealing member and the underside of seat ring 22'. Alternatively, the top edge portion 86 of disposable bag 74 may be placed between the sealing member 70 and the top edge portion 68 of mesh bag holder 60 (i.e. the sealing member may be used to selectively clamp both the mesh bag holder and the disposable bag to the top edge 56 of the inner radial wall 50). Yet, still another option is to drape the top edge 86 of the disposable bag over the top surface of the seat ring 22' when the latter is in its down or operative position because during use the main portion of the disposable bag 74 will be supported by the main portion of the mesh bag holder. This latter alternative arrangement of the disposable bag top edge portion being draped directly over the top surface of the seat ring 22' when employed in connection with the apparatus of the present invention has the further advantage of providing a disposable sanitary (albeit temporary) covering for the top surface of the seat ring 22'. After use of the apparatus, a soiled disposable bag 74 easily may be removed, placed in its protective ZIP-LOK™ bag and disposed above in a convenient environmentally friendly manner. The mesh bag holder and the sealing member, if desired, may be left in place when the apparatus is folded and the cover(s) installed, ready for reuse as needed because the mesh bag is easily folded into a compact form. It will be appreciated that by virtue of the mesh bag construction and the easily detachable flexible sealing member used therewith, the mesh bag holder may be removed at any time for installation of a new mesh bag holder or for cleaning purposes. It will be appreciated that the mesh bag holder 60 is much less expensive to fabricate than the accordion-like bag holder of the prior embodiment. Finally, it will be understood that the size of the mesh openings in the mesh bag holder is not critical and that known flexible woven or non-woven fabrics or other flexible material capable of serving the function described may be used instead without departing from the principles of the invention.

Figure 15:
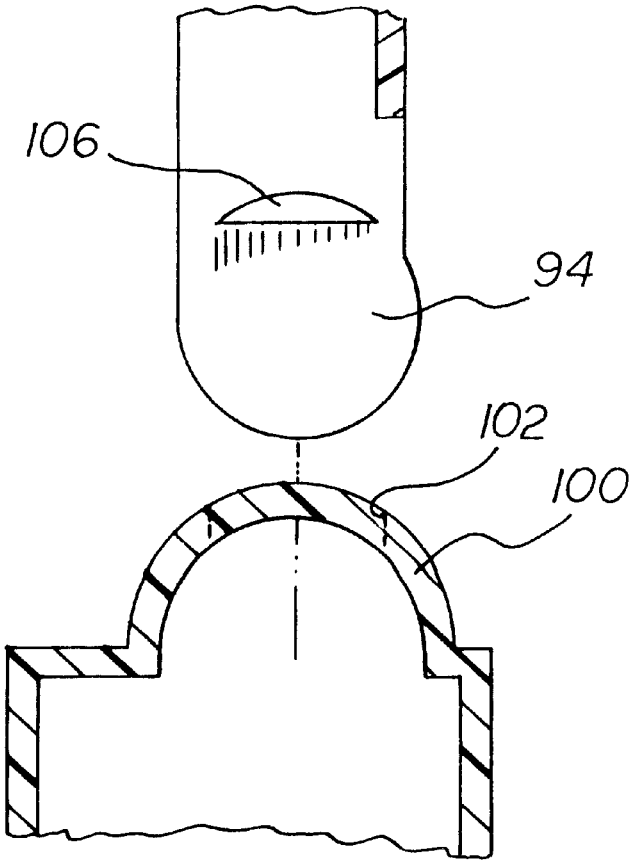
FIG. 15 is an enlarged cross-sectional view of a portion of an hinge arm and its locking member in respect of the alternatively preferred embodiment of FIG. 10 schematically these parts in an un-engaged position prior to engagement with an hinge bracket.

Another feature of the mostly preferred embodiment comprises the novel seat unit hinge structure shown in FIGS. 10, and 12–15. At the rear edge of 90 od seat unit 18' there are disposed first and second pairs of protruding hinge arms 92, 94 and 96, 98. Each pair of hinge arms is adapted to removably engage a corresponding hinge arm receiving bracket 100 and 102, respectively. The operation of the hinge arms and hinge arm receiving brackets are the same, therefore a description of one will suffice for the other. Hinge arm receiving bracket 100 comprises a hollow cylindrical housing fixed to base member 12' and having opposed ends each with a rectangular shaped notch 102, 104 at the top-most or twelve o'clock position. The confronting inwardly facing surfaces of hinge arms 92 and 94 each have a semi-circular shaped locking member 106 joined therewith substantially as shown. The locking members 106 are designed to pass through the notches (102 and/or 104) when the seat unit 22' is held in a vertical position and moved downwardly (FIG. 15). Rotation of the seat unit to the left as viewed in FIG. 14 causes the locking members to rotate beyond the notches (102 and/or 104) and be captured in non-notched edge sections of the cylindrical bracket 100 thereby capturing the seat unit relative to the base unit in its appropriate position, yet permitting the seat unit to be rotated relative to the base unit 12' between an upright position (FIG. 16) and a down or operative position (FIGS. 10–12 and 14). The hinge arms protrude from a raised rectangular platform 108 and 110 each of which defines a slightly angled bearing surface 112, 114 on the lateral outboard side of each hinge arm surface. The bearing surfaces engage 112, 114 are adapted to come into contact with a flat bearing surface 116 on base member 12' (see FIG. 12) when the seat unit 18' is in a raised position (FIG. 16) which position is an obtuse angle with respect to an imaginary horizontal plane passing through the surface 116. By the foregoing arrangement, the seat unit 18' may be raised beyond top dead center of each hinge arm bracket (where stop members 106 cannot be withdrawn from notches 102, 104) and caused to come to rest in the up or raised position (surface 112 engages surface 116) with a slight lean to the right as viewed in FIG. 16 thereby permitting easy access to the mesh bag holder 60, the flexible sealing member 70, and the disposable bag 74.

Still another feature of the mostly preferred embodiment is the use a single, standard dimensioned and configured cover that my be used alternatively to attach to the base member 12' for purposes of covering either the top surface or the bottom surface thereof. Such a cover and the modified base member it is to be used with, in accordance with the invention, is depicted in FIGS. 17 and 18 and indicated generally by reference sign 120. Cover 120 includes a first pair of front latch tabs 122, 124 oriented in the same manner on the front edge thereof, i.e. with a notched side facing left as viewed in FIGS. 17 and 18. The latch tabs 122, 124 are symmetrically located on the front end wall of the cover. The notched latch tabs 122, 124 are adapted to releasably lockingly engage suitable latch tab receiving apertures located in two pairs of stacked arrays 130, 132 and 134, 136 located on the front wall of base member 12' whether inserted downwardly as a top cover or inserted upwardly as a bottom cover.

Cover 120 further includes a second pair of latch tabs 140, 142 which are identically shaped, but are asymmetrical located on the opposed rear end wall of the cover member 120. The second pair of latch tabs are adapted to releasably lockingly engage suitable latch tab receiving apertures located in two pairs of spaced apart units 144, 146 and 148, 150 located on the rear wall of base member 12'. When the cover is inserted downwardly from the top, the pair of latch tabs 140, 142 is engaged with top latch tab receiving apertures 144, 146, respectively. When the cover is inserted upwardly from the bottom, the same pair of latch tabs 140, 142 is engaged with bottom latch tab receiving apertures 148, 150, respectively. It is thus seen that a single cover of standard size and configuration may be used as the top cover or the bottom cover for the base member 12'.

The components of the portable potty apparatus of the invention can be made from inexpensive and durable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved portable potty apparatus that is low in cost, relatively simple in design and operation, and which advantageously has several legs that rest on a support surface. With the invention, a portable potty apparatus is provided which has a seat ring. With the invention, a portable potty apparatus is provided which has a carry handle that facilitates transport of the portable toilet when it is not in use. With the invention, a portable potty apparatus is provided which permits the use of disposable bags that are considerably smaller than the full outside length and width of the base portion. With the invention, a portable potty apparatus is provided which uses readily available, pre-made, disposable plastic bags. With the invention, a portable potty apparatus is provided which uses flexible disposable bags for receiving wastes. With the invention, a portable potty apparatus is provided which has an integrated structure which has both a seat ring and a disposable bag holder. With the invention, a portable potty apparatus is provided which has a seat ring structure connected to a base by means of a hinge and which rotates around the hinge when the seat ring is lifted. With the invention, a portable potty apparatus is provided which has both a top cover and a bottom cover to cover both the top and bottom portions of the portable toilet, respectively. With the invention, a portable potty apparatus is provided which holds a disposable bag in such a way that the disposable bag is not subjected to significant tearing forces. With the invention, a portable potty apparatus is provided which has a unique disposable bag holder with an easy to use flexible retainer member. With the invention, a portable potty apparatus is provided which) has a uniquely shaped disposable bag. With the invention, a portable potty apparatus is provided which has a hingedly mounted seat unit with a seat ring which unit may be removed, elevated to a preferred non-use position, or maintained in a down, operative use position. With the invention, a portable potty apparatus is provided which has a single cover of standard size and configuration which may be used to cover either the top or the bottom of the apparatus when the apparatus is in a folded-up non use storage mode.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by letters patent of the United States is as follows:

1. A portable potty apparatus, comprising:

a base unit, a seat unit movably supported on said base unit, and a plurality of folding legs connected to said base unit to support said base unit above a supporting surface when said legs are unfolded, said base unit including an upstanding annular wall for supporting said movably supported seat unit thereon, a flexible bag holder, said flexible bag holder adapted to extend from said annular wall in proximity to said movable seat unit, and a disposable bag, said disposable bag being adapted to be at least partially supported by said bag holder for collecting waste material, further including a clamping member removable from engagement between said base unit and said seat unit for removably attaching said flexible bag holder to at lease a portion of said upstanding annular wall, wherein said disposable bag has a first closed portion for insertion within said flexible bag holder and a second open portion for engagement between said movable seat unit and said clamping member when said clamping member attaches said flexible bag holder to said at least portion of said upstanding annular wall.

2. The apparatus of claim 1 wherein said flexible bag holder is comprised of mesh-like material.

3. The apparatus of claim 1 wherein said disposable bag first closed portion comprises a confinement space adapted to receive a quantity of waste material gelling compound.

4. The apparatus of claim 3 wherein said first closed portion comprises a first medial portion, a first lateral portion disposed at an angle to said first medial portion on one end thereof, and a second lateral portion disposed at an angle to said first medial portion on another opposed end thereof whereby said second open portion of said disposable bag and said first lateral portion and said second lateral portion define a funnel for channelling waste from said second open portion to said first medial portion.

5. The apparatus of claim 1 wherein said movable seat unit is joined to said base unit by a hinge unit, said hinge unit comprising a pair of hinge arms protruding from said movable seat unit and a hinge bracket on said base unit for receiving said pair of hinge arms, and wherein said hinge arms include a locking member associated therewith for enabling removal of said hinge arms from said hinge bracket in a predetermined orientation of said movable seat unit relative to said base unit.

6. The apparatus of claim 5 wherein said pair of hinge arms has associated therewith an arresting surface for engaging a step surface on said base unit and preventing unlimited rotation of said movable seat unit relative to said base unit by the action of said hinge unit.

7. The apparatus of claim 1 wherein said clamping member is flexible and has a U-shaped transverse cross-sectional shape defining a pair of spaced leg portions extending longitudinally along said clamping member, and at least one of said leg portions includes a barbed retaining ridge extending toward the other of said leg members.

8. A portable potty apparatus, comprising:

a base unit, a movable seat unit on said base unit, and a plurality of folding legs connected to said base unit to support said base unit above a supporting surface when said legs are unfolded, said base unit including an annular wall in proximity to said seat unit, a flexible bag holder, said flexible bag holder extending from said annular wall in proximity to said seat unit, and a disposable bag at least partially supported by said bag holder for collecting waste material, wherein said base unit and said movable seat unit define a top surface of said apparatus and said plurality of folding legs defines a bottom surface of said apparatus, further including a first cover, said first cover being adapted to be selectively attached to either said top surface of said apparatus or to said bottom surface of said apparatus.

9. The apparatus of claim 8 further including a second cover, said first cover and said second cover being identical to one another, wherein said first cover is attachable to said top surface of said apparatus and wherein said second cover is attachable to said bottom surface of said apparatus.

10. A portable potty apparatus, comprising:

a base unit which includes a top base surface and a bottom base surface, said top base surface and said bottom base surface having a first central opening extending therebetween, a seat unit having a second central opening therein, said seat unit adapted to be fitted on said top base surface of said base unit with said second central opening communicating with said first central opening, and a plurality of folding legs connected to said bottom base surface, wherein:

said top base surface including an annular groove surrounding at least a portion of said first central opening, said annular groove defining a first annular wall having a first top edge surface and a second annular wall radially spaced from said first annular wall defining a second top edge surface, said second central opening of said seat unit defining an annular seat ring portion of said seat unit surrounding at least a portion of said second central opening thereof, said apparatus further including in combination therewith:

a bag holder for a disposable waste bag, said bag holder having a rim portion and a body portion, at least a portion of said rim portion being adapted to be received between said annular seat ring portion and said base unit and within said annular groove defined by said first top edge surface and said radially spaced second top edge surface when said seat unit is fitted on said base unit such that said body portion of said bag holder extends through said first central opening of said base unit, and said annular portion of said seat ring is engaged by and supported by one of said first annular wall top edge surface or said second annular wall top edge surface to securely anchor said rim portion of said bag holder to said base unit and said seat ring when said apparatus is in use.

11. A portable potty apparatus, comprising:

a base unit which includes a top base surface and a bottom base surface, a seat unit having waste receiving hole therethrough, said seat unit being adapted to be disposed on said base unit top base surface, and a plurality of folding legs connected to said bottom base surface, wherein said folding legs include:

a front leg, and a pair of rear legs, and wherein said base unit includes a peripheral side wall having a bottom edge and said peripheral side wall defines a receptacle in said bottom base surface, said front leg and said rear legs being hingedly attached to said bottom base surface such that each said leg may be folded between an inoperative position where said corresponding leg is folded substantially flat against said bottom base surface within said receptacle and an operative position where each said leg extends beyond said peripheral side wall bottom edge thereby to support said base unit in an elevated position relative to a support surface engaged by said legs, each of said legs being attached to said base unit bottom surface by a corresponding hinge assembly defining a separate hinge axis substantially parallel to said base unit bottom surface, respectively, and wherein each said hinge axis of said rear legs intersects the other at an angle and each also intersects the hinge axis of the front leg, the hinge axis of the front leg being parallel to an adjacent front edge portion of said bottom base surface.

12. The apparatus of claim 11 wherein each of said front leg and said rear legs includes a leg hinge portion which is received in a complimentary leg hinge reception portion in said base unit.

13. A portable potty apparatus, comprising:

a base unit which includes a top base surface and a bottom base surface, a seat unit, a hinge connected between said base unit and said seat unit, and a plurality of folding legs connected to said bottom base surface, further including:

a top cover for connection to said base unit, wherein said top cover includes top cover lock tabs, and said base unit includes lock tab reception slots for receiving said top cover lock tabs, further including:

a bottom cover for connection to said unit, wherein said bottom cover includes bottom cover lock tabs which fit into said lock tab reception slots, and wherein said top cover lock tabs and said bottom cover lock tabs are offset from each other so that a single top cover lock tab and a single bottom cover lock tab can share a lock tab reception slot when said top cover and said bottom cover are connected to said base unit.

14. The apparatus of claim 13 wherein said bottom cover further includes bottom side engagement tabs for engaging said bottom base surface when said bottom cover is connected to said base unit.

* * * * *